US005148777A

United States Patent [19]

Brockhurst

[11] Patent Number: 5,148,777

[45] Date of Patent: Sep. 22, 1992

[54] METHOD OF, AND APPARATUS FOR, KILLING MARINE LIFE IN AND ABOUT THE COOLING SYSTEM OF A MARINE VEHICLE

[75] Inventor: John V. Brockhurst, Angola, N.Y.

[73] Assignee: JVB Development, Inc., Angola, N.Y.

[21] Appl. No.: 826,010

[22] Filed: Jan. 27, 1992

[51] Int. Cl.[5] ..... F01P 5/14

[52] U.S. Cl. ..... 123/41.15; 123/198 E

[58] Field of Search ..... 123/41.15, 198 E

[56] References Cited

U.S. PATENT DOCUMENTS 4,524,736 6/1985 Sackett ..... 123/41.15

4,598,278 7/1986 Ford ..... 123/41.15

*Primary Examiner*—Noah P. Kamen

*Attorney, Agent, or Firm*—Sommer, Oliverio & Sommer

[57] ABSTRACT

Apparatus for killing marine life, such as zebra mussels, in the cooling system (14) of a boat having a water-cooled internal combustion engine (11) includes a flexible bag-like enclosure (20) which is adapted to be mounted on the boat so as to provide a closed volume of water communicating with the cooling system inlet (18) and cooling system outlet (19). When the engine is allowed to idle in neutral, cooling water is drawn from the enclosure and is circulated through the cooling system in heat exchange relation to the engine, and is discharged back into the enclosure. The temperature of water in the enclosure and cooling system will therefor increase. After the engine has been operated for a period of time, the temperature of water in the enclosure and the cooling system will increase to a level necessary to kill marine life in the cooling system.

13 Claims, 1 Drawing Sheet

METHOD OF, AND APPARATUS FOR, KILLING MARINE LIFE IN AND ABOUT THE COOLING SYSTEM OF A MARINE VEHICLE

TECHNICAL FIELD

The present invention relates generally to the field of methods of, and apparatus for, killing marine life, such as zebra mussels, tube worms and the like, in and about the cooling system of a water-cooled marine vehicle, such as a boat.

BACKGROUND ART

There are many different types of recreational boats. These include outboards and inboard-outboards, sometimes known as stern drives. These boats typically have an internal combustion engine, either gasoline- or diesel-powered, arranged to drive a submerged propulsion system. These types of drives are typically water-cooled. More particularly, ambient water is drawn into the engine's cooling system, is circulated in heat exchange relation within the engine, and is discharged back into the ambient water. Thus, the effectiveness of such cooling systems depends upon the ability of water to circulate freely therewithin.

While many different types of marine life can enter and grow within, such cooling systems, particularly if the boat remains in the water but is used only intermittently, the problem of cooling system occlusion has recently been accentuated with the introduction of the zebra mussel into the Great Lakes and other waterways. Analogous problems are known to exist in salt water, where tube worms may attach themselves within conduits and passageways of marine cooling systems.

The zebra mussel, *dreissena polymorpha*, is a relatively-small bivalve mollusk with elongated thick shells marked by alternating light and dark bands. Thought to be native to the Black and Caspian Seas, the zebra mussel was reportedly introduced into European fresh water ports in the late 18th century. It proliferated during the next 150 years, and is now found throughout virtually all European inland waterways. Although the specific path of its introduction into North America is unknown, it is believed to have been transported from Europe in ships' ballasts, which were discharged into the Great Lakes. The zebra mussel was first discovered in Lake St. Clair in June of 1988. Having few natural enemies in North America, it has again proliferated, and is now found in all of the Great Lakes. The largest infestations are believed to presently be in the St. Clair River, Lake St. Clair, the Detroit River, Lake Erie, Lake Ontario, and the Erie Barge Canal. However, the ecosystem of the Great Lakes is favorable to the zebra mussel, and it is expected to continue to proliferate.

The zebra mussel will attach itself to almost any hard surface, and poses a substantial threat to public water supplies, lake ecology and recreation, such as swimming, fishing and boating. The threat of such barnacle-like colonization to submerged water intakes, pipes and conduits is well documented. Utilities are now devoting considerable time and attention to the removal or management of these colonies. Left unchecked, the incrustations can result in progressive constrictions of such flow passageways.

Zebra mussels can be transported to new areas as both larvae and as adults. The microscopic larvae, known as veligers, will readily pass through even fine-mesh screens. Mature female mussels can reportedly produce between 30,000 to 40,000 eggs per year in water temperatures of about 12° C. (54° F.). The veligers are reportedly capable of active swimming for one to two weeks following hatching, enabling them to travel for considerable distances from their parent colonies. Within three weeks of hatching, the young veligers reach the "settling stage", at which they attach themselves to submerged objects. These young mussels are capable of crawling along submerged objects at speeds on the order of 3.8 centimeters per hour until they find a suitable location at which to attach. The young mussels show an affinity of attaching to firm substrates in water currents of less than 2.5 meters per second. After attaching to the substrate, the young zebra mussels grow rapidly, and may reach an adult length of about 5 centimeters. The average life span is about 3.5 years, but can be as high as five years under ideal conditions.

Zebra mussels filter phytoplankton (i.e., microscopic plants and many forms of algae) from the water. It has been reported that an average single mature zebra mussel can filter about one liter of water per day. Since its recent introduction into the Great Lakes, some researchers have reported a two-fold increase in water clarity in mussel-infested areas. While this may appear to be desirable at first blush, by removing phytoplankton, the zebra mussel upsets the ecological balance in a lake or waterway, and threatens fish population. Some swimmers in infested areas are now reported to wear foot gear to avoid being cut by mussel shells.

The zebra mussel is also known to have a substantial impact on recreational boating. The mussels may attach themselves to the exterior surfaces of boat hulls, thereby increasing drag and reducing fuel efficiency. Such mussels may also enter the cooling system of recreational boats through submerged water intakes, particularly if a boat is tied to a dock or otherwise moored for long periods of time between use. Left unchecked, the mussels may progressively constrict the opening of various passageways, thereby impeding the intended free flow of cooling water through the cooling system.

Considerable research is being currently directed to the development of various techniques for controlling and removing mussel colonies. While the mussels attach themselves tenaciously to submerged surfaces, they may be physically scraped therefrom. Such scraping may be the preferred form of mussel removal from the exterior surfaces of boat hulls, but is somewhat difficult to effect in closed passages, such as the internal passageways of a cooling system.

It is also known that the mussels may be killed by oxygen deprivation. It is reported that exposure to anaerobic water at about 23°-24° C. (73.5°-75° F.) for two to three days will result in 100% mortality. Certain gases, such as hydrogen sulfide, may be added to increase the effectiveness of such oxygen deprivation techniques.

Other experiments involve the use of metallic ion control, and chemical control. Chemical control may be effected through the use of chlorinization, ozone, copper sulfate or the like. The problem here is that such chemicals are disfavored because of their toxic discharges into waterways.

It is also known that zebra mussels are sensitive to heat. It has been reported that zebra mussels will begin to die in water temperatures exceeding about 37° C. (98.6° F.) and that most mussels will be killed quickly by exposure to water temperatures of between 45°-55° C.

(113°–131° F.) for a minimum of ten minutes. Moreover, upon application of heat of this order, the mussels tend to die with their shells slightly open, promoting exposure and degeneration of the byssal threads by which the mussels attach themselves to the substrate. It has been further reported that exposure to heat greater than about 60° C. (140° F.) results in virtually-immediate mussel mortality. Because of this, boaters have been advised to wash their boats, and flush their cooling systems, with hot water on the order of about 135°–145° F.

Because a source of hot water may not be readily available to many boaters, let alone to those who keep their boats in the water for extended periods, there is an immediate and pressing need for an improved method of killing marine life, such as zebra mussels, within the engine cooling system of such boats.

DISCLOSURE OF THE INVENTION

The present invention provides a simple and yet highly effective of, and apparatus for, killing marine life, such as (but not limited to) the zebra mussel, in and about the cooling system of a marine vehicle, such as (but not limited to) a boat, having a water-cooled internal combustion engine. The cooling system has an inlet passageway extending between a submerged inlet port and the engine and through which cooling water is drawn and supplied to the engine, and has an outlet passageway extending between the engine and an outlet port and through which heated cooling water is discharged.

The improved method broadly comprises the steps of: providing an enclosure temporarily about the inlet and outlet ports such that water circulating through the cooling system is drawn from, and discharged back into, this enclosure; and operating the engine in neutral to cause the temperature of water within the enclosure and cooling system to increase to a predetermined minimum temperature; thereby to cause marine life within the cooling system and the enclosure to be killed by the increased temperature in the enclosure.

In another aspect, the invention provides an improved apparatus for killing marine life in and about such a cooling system. The improved apparatus broadly comprises: an enclosure adapted to be temporarily mounted on the boat so as to provide a closed volume of water communicating with the inlet and outlet ports such that, if the engine is operated, water will be drawn from the enclosure into the inlet passageway, circulated in heat exchange relation with the engine, and then discharged from the outlet passageway back into the closed volume. The enclosure is formed of a suitable material, and is so dimensioned, proportioned and arranged that, when the engine is operated for a period of time, the length of which depends on many factors (e.g., the ambient water temperature, the engine speed, the volume of water in the cooling system and the enclosure, etc.), the average temperature within the enclosure and the cooling system will increase to a predetermined minimum temperature; whereby marine life, such as (but not limited to) zebra mussels and larvae thereof, will be killed by the increased water temperature in the enclosure and cooling system. The predetermined minimum water temperature may be on the order of 135°–140° F. if the targeted marine life are zebra mussels. Thereafter, the enclosure may be removed to allow normal operation of the marine vehicle.

Accordingly, the general object of this invention is to provide an improved method of, and apparatus for, killing marine life within and about the cooling system of a boat or other water-cooled marine vehicle.

Another object is to provide an improved method of, and apparatus for, killing zebra mussels and veligers within and about a marine cooling system.

Another object is to provide an improved method of, and apparatus for, killing zebra mussels and veligers within and about a boat cooling system, which apparatus comprises a relatively low-cost bag-like enclosure which the recreational boater may use at his own convenience to kill marine life in the cooling system of his boat.

Still another object is to provide a bag-like enclosure which is adapted to surround and be supported by a stern-drive unit of a boat, which permits the boater to kill marine life within the cooling system and on the stern-drive unit.

These and other objects and advantages will become apparent from the foregoing and ongoing written specification, the drawings, and the appended claims.

DESCRIPTION OF THE PREFERRED EMBODIMENT(S)

Figure 1:
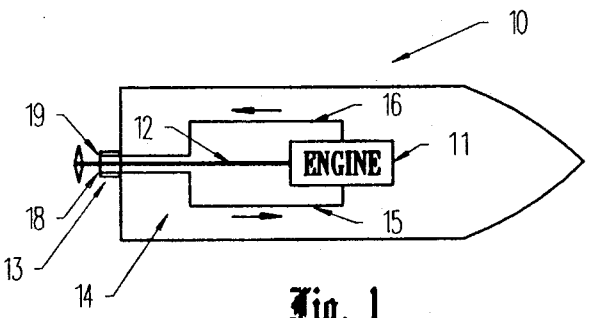
FIG. 1 is a schematic view of the cooling system of a boat, this view showing the inlet passageway as extending between the inlet port and the engine for drawing cooling water into the engine, and showing the outlet passageway as extending between the engine and the outlet port for discharging heated cooling water.
Figure 4:
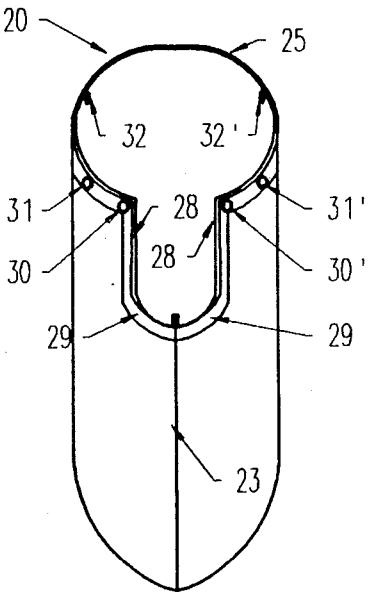
FIG. 4 is a front perspective view of the bag-like enclosure in an expanded condition.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Referring now to the drawings, the present invention provides an improved method of, and apparatus for, killing marine life in and about the cooling system of a marine vehicle, such as a boat.

In FIG. 1, a boat, schematically indicated at 10, is shown as having a water-cooled engine 11. Engine 11 is an internal combustion engine, which may be either gasoline- or diesel-fueled. In either event,engine 11 is arranged to power, via line 12, the submerged propeller of an out-drive unit 13. The engine has a cooling system, generally indicated at 14, which includes an inlet passageway 15 and an outlet passageway 16. The inlet passageway extends between an inlet port 18 and the engine, and the outlet passageway 16 communicates the engine with an outlet port 19. In FIG. 1, the inlet and outlet ports are shown as being operatively mounted on the out-drive unit, although they need not necessarily be so. Thus, cooling water is drawn into the cooling system through the inlet port, and is circulated via inlet passageway 15 to the engine. Heat generated by the engine is transferred to the cooling water, which is then discharged via outlet passageway 16 and discharge port 19. Zebra mussels may attach to the inlet passageway or the outlet passageway, and the shells of dislodged mussels may actually impact against the impeller of an engine-mounted pump (not shown) by which water is circulated through the cooling system.

Figure 2:
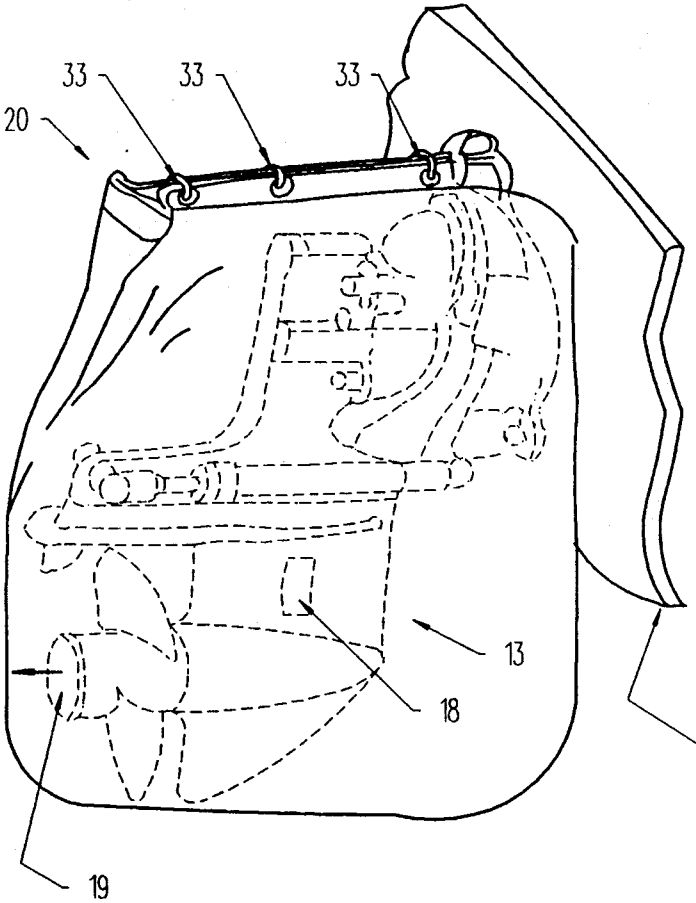
FIG. 2 is a fragmentary perspective view showing the bag-like enclosure as operatively surrounding an out-drive unit, this view also showing the uppermost open mouth of the container as having been closed.

FIG. 2 depicts the improved enclosure, generally indicated at 20, as enclosing the out-drive unit 13 (shown in phantom). The out-drive unit is shown as extending rearwardly from the transom 21 of a boat. In this view, one cooling system inlet port is again indicated at 18, and the outlet port 19 and exhaust for the gaseous products of combustion are located within the propeller. In actual practice, there may be multiple inlet ports and/or multiple outlet ports.

Figure 3:
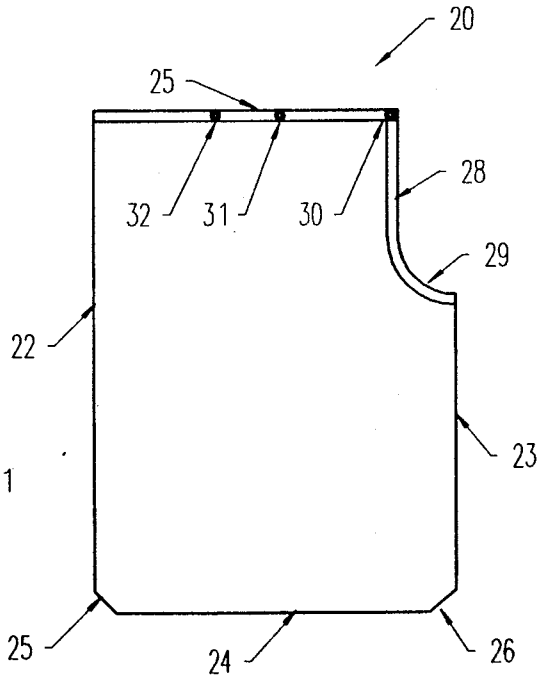
FIG. 3 is a side elevational view of the bag-like enclosure shown in FIG. 2, this view depicting the enclosure in a folded-flat condition.

Referring now to FIG. 3, the bag-like enclosure 20 is shown as having been formed of a suitable length of sheet material cut from a blank and folded to form a left marginal edge 22. The presently-preferred embodiment is formed of a 22-oz. PVC-coated polyester fabric, although other types of materials may be substituted therefor. The various other edges of this sheet material are tucked inside the enclosure, overlapped and suitably heat-sealed and/or sewn to form an open-mouthed bag-like enclosure. The enclosure is shown as having a horizontal lower edge 24, and beveled corners 25, 26 between the left and right marginal ends of lower edge 24 and left and right edges 22, 23, respectively. The enclosure is also shown as having an upper marginal edge 25 about its open mouth. The bag is provided with a generally U-shaped corner recess between the top edge and right edges. This recess is bounded by a vertical portions 28, 28 extending downwardly from the distal marginal end portions of top edge 25, and arcuate portions 29, 29 continuing downwardly therefrom to join one another at the upper margin of right edge 23. The marginal end portions adjacent the top edge 25 and recess edges 28, 29 are shown as being reinforced, by folding the marginal end portions adjacent these edges over on to themselves, and heat sealing and/or sewing such folded marginal end portions to the body of the enclosure. The marginal end portion adjacent the mouth are provided with six spaced grommets, indicated at 30,30', 31,31', and 32,32', respectively. The size and spacing of these grommets is largely dependent upon the particular configuration of the out-drive unit to be enclosed. Hence, the number and spacing between these grommets may be readily changed or modified, as desired.

In use, the boater simply places the bag-like enclosure about the out-drive unit of his boat, enclosing a volume of water therewithin, and closes the upper open mouth thereof by means of one or more suitable tying devices, generally indicated at 33, passing through the various grommets. Tying device 33 may be one or more lengths of rope or cord, a special quick-attaching fastener, such as used to close garbage bags, or virtually any other device for temporarily closing the open mouth of the enclosure. The enclosure recess defined by edges 28,28 29,29 will therefore fit about the transom-mounted housing of the out-drive unit. When the mouth of the bag is closed, the bag will simply rest on, and be supported by, the out-drive unit, and will enclose a volume of water therewithin. Inlet port 18 and outlet port 19 are submerged within the volume of water trapped within the bag-like enclosure.

After the bag has been so mounted, the operator starts his engine, and allows it to idle (not necessarily at the minimum idle speed) in neutral. In other words, the operator does not attempt to engage the out-drive unit so as to propel the vehicle either forwardly or rearwardly. Rather, the engine remains disengaged from the propeller. Initially, the temperature of water within the enclosure will be substantially the same as that of the ambient water. As the engine is allowed to operate, however, cooling water will be drawn into the cooling system through inlet port 18, circulated through inlet passageway 15 in heat-exchange relation with engine 11, and will be discharged via outlet passageway 16 and outlet port 19 back into the enclosure. Thus, the temperature of water within the enclosure and the cooling system, will begin to increase. The operator monitors the temperature in his cooling system either through temperature gauges (not shown) mounted on the console of the boat, or by means of a thermometer (not shown). The engine is operated for a period of time until the temperature in the cooling system and enclosure increases to a certain predetermined minimum temperature. This temperature and the length of time needed to obtain it, will depend on many factors, such as the temperature of the ambient water, the volume of water trapped within the cooling system and the enclosure, and the like. Thus, the operator simply monitors the temperature within the bag-like enclosure and cooling system until the actual temperature therein equals or exceeds the desired minimum temperature.

As indicated above, it has been found that zebra mussels will be killed almost immediately if exposed to temperature on the order of 135°-140° F. On the other hand, if the operator is unable to cause the temperature to rise to this level, perhaps when the ambient water is cold, he may allow the engine to operate for a longer period of time. In other words, if the operator is unable to cause the temperature to increase to 135°-140° F., he may still subject the mussels to a lethal dosage of heat by subjecting them to a lower elevated temperature for a longer period of time. This may have the added advantage of causing the mussels to die within their shells open, thereby fully exposing the byssal threads by which they have attached themselves within the cooling system. Thus, the predetermined minimum temperature, as used herein, is not necessarily on the order of 135°-140° F.

After the engine has been operated for the amount of time necessary to allow the temperature within the enclosure and cooling system to rise to the predetermined minimum temperature, the operator simply turns off his engine, and removes the bag-like enclosure from his propulsion unit. Once removed, the bag-like enclosure may be folded and stored for subsequent reuse.

Thereafter, the operator may operate his boat in the conventional manner.

The elevated temperature caused by permitting the engine to operate in neutral so as to increase the temperature within the cooling system and the bag-like enclosure will, therefore, kill marine life in the cooling system. In addition to this, the gaseous products of combustion may be discharged through the outlet port, and some of these may contribute to oxygen deprivation within the enclosure. More particularly, it is believed that the water within the cooling system and the enclosure will quickly become saturated with carbon monoxide (CO), and this is thought to further assist in killing the marine life within the cooling system. In the preferred embodiment, the bag-like enclosure surrounds the stern-drive unit. Hence, marine life within the cooling system and on the stern-drive unit will be killed.

Therefore, the invention provides simple, but yet effective, apparatus for killing marine life in the cooling system of a marine vehicle having a water-cooled internal combustion engine. The cooling system has an inlet passageway communicating an inlet port and the engine and through which cooling water is drawn and supplied to the engine, and has an exhaust passageway communicating the engine with an outlet port and through which such cooling water, heated by the engine, is discharged. The apparatus comprises an enclosure which is adapted to be temporarily mounted on a vehicle so as to provide a closed volume of water communicating both with the inlet and outlet ports so that, if the engine is operated, cooling water will be drawn into, and circulated through, the cooling system passageways, and heated water will be discharged back into the closed volume. The enclosure is constructed of a suitable material and is so dimensioned, proportioned and arranged that, if the engine is operated for a period of time, the average temperature within the enclosure and the cooling system will increase to such a level that marine life within the cooling system will be killed. Thereafter, the enclosure is simply removed, and stored for subsequent reuse. In the preferred form, the enclosure is simply a bag-like device which may be readily folded and stored between uses.

In the use of such apparatus, the operator performs a method of killing marine life in the cooling system of a marine vehicle, which method comprises the steps of: providing an enclosure about the inlet and outlet ports so that water circulated through the cooling system is drawn from, and discharged back into, the closed volume of the enclosure; and operating the engine so as to cause the temperature of water in the cooling system and the enclosure to increase to a predetermined minimum temperature; thereby to cause marine life in the cooling system to be killed by the increased temperature, possibly inter alia, in the enclosure.

MODIFICATIONS

Persons skilled in this art will readily appreciate that various changes and modifications may be made. For example, the particular shape of the enclosure is not deemed critical. As indicated above, it is presently preferred that the enclosure be flexible so that it may be folded and stored when not in use. This arrangement is not invariable, however, and other shapes and configurations may be used. Different enclosure configurations may be used for different types of boats. For example, the particular form shown in the drawings may suitable for use with the out-drive unit of a stern-drive boat. For use with outboards, other shapes and configurations may be used as well. For use with inboards, the enclosure may simply be a tube or passageway, or some other means defining a closed volume, selectively communicating the cooling system outlet with the cooling system inlet. The particular material of construction is not deemed critical, and may be readily changed or modified as desired. Needless to say, such material should be of sufficient strength as to permit re-use of the enclosure. Such material should also provide some impediment to heat transfer between the heated volume of water within the enclosure and the ambient water.

The particular means for closing the open mouth of the enclosure may also be changed as desired. For simplicity, the preferred form is shown as having a plurality of grommets, and a suitable tying device (e.g., a rope, cord, tie, or the like) may be selectively engaged with two or more of these grommets to close the open mouth thereof. In the preferred form, the closed open mouth of the enclosure will simply rest on the out-drive unit. This too is not invariable, and other means or mechanisms for supporting the enclosure might possibly be substituted therefor.

Moreover, the time of engine operation and the temperature of the heated cooling system water, are interrelated. For example, if the ambient water is relatively cold, it may be necessary to operate the engine for a longer period of time because of the increased heat transfer through the bag walls. If it is not possible to reach the ideal operating temperature, the operator may wish to operate the engine for a longer period of time to effectively kill marine life within the cooling system. If the enclosure is a bag-like device which encircles a stern-drive unit, the increased heat and/or saturated gaseous products of combustion will kill marine life within the cooling system and on exposed portions of the stern-drive unit.

Therefore, while the preferred form of the improved apparatus has been shown and described, and several changes and modifications thereof discussed, persons skilled in this art will readily appreciate that various additional changes and modifications may be made without departing from the spirit of the invention, as defined and differentiated by the following claims.

What is claimed is:

1. A method of killing marine life in the cooling system of a marine vehicle having a water-cooled internal combustion engine, said cooling system having an inlet passageway extending between an inlet port and said engine and through which cooling water is drawn and supplied to said engine in heat-exchange relation thereto, and having an outlet passageway extending between said engine and an outlet port and through which heated cooling water from said engine is discharged, which method comprises the steps of:

providing an enclosure about said inlet and outlet ports such that water circulated through said cooling system will be drawn from, and discharged back into, said enclosure; and operating said engine so as to cause the temperature of the water within said enclosure and said cooling system to increase to a predetermined minimum temperature;

thereby to cause marine life in said enclosure and cooling system to be killed by the increased temperature of water within said cooling system and enclosure.

2. A method as set forth in claim 1, and further comprising the additional step of: removing said enclosure after such marine life has been killed.

3. The method as set forth in claim 1 wherein said engine has a gaseous exhaust which is also discharged into said enclosure, and wherein said marine life is killed by the combustion of heat and by the effect of at least one product of combustion in said gaseous exhaust.

4. The method as set forth in claim 1 wherein said marine vehicle is of the inboard-outboard type having an out-drive unit, and wherein said enclosure is provided about said out-drive unit.

5. The method as set forth in claim 1 wherein said predetermined temperature is about 135°-140° F.

6. The method as set forth in claim 1, wherein said enclosure is supported by said vehicle.

7. Apparatus for killing marine life in the cooling system of a marine vehicle having a water-cooled internal combustion engine, said cooling system having an inlet passageway extending between an inlet port and said engine, and having an outlet passageway extending between said engine and an outlet port, said apparatus comprising:

an enclosure adapted to be mounted on said vehicle so as to provide a closed volume of water communicating with said inlet and outlet ports so that, if said engine is operated, cooling water will be drawn from said closed volume into said inlet passageway and will be discharged from said outlet passageway back into said closed volume, said enclosure being formed of a suitable material and being so dimensioned, proportioned and arranged that, if said engine is operated for a period of time, the average temperature within said enclosure and said cooling system will increase to a predetermined minimum temperature;

whereby marine life in said cooling system and enclosure will be killed by the increased temperature of water in said cooling system.

8. The apparatus as set forth in claim 7 wherein said engine has gaseous exhaust which is also discharged into said enclosure such that at least one product of combustion in said exhaust will contribute to the killing of marine life in said cooling system and enclosure.

9. The apparatus as set forth in claim 8 wherein said marine vehicle has an inboard-outboard type of propulsion system having an out-drive unit.

10. The apparatus as set forth in claim 9 wherein said enclosure is an open-mouth bag-like device adapted to fit about said out-drive unit, and having holding means for holding said bag-like device in an operative position about said out-drive unit when it is desired to kill marine life in said cooling system.

11. The apparatus as set forth in claim 10 wherein said holding means includes a plurality of grommets provided in a marginal end portion of said enclosure adjacent the mouth of same, and closure means passing through said grommets for closing said mouth after it has been placed about said out-drive unit.

12. The improvement as set forth in claim 11 wherein such closed bag is supported by said out-drive unit.

13. The apparatus as set forth in claim 10 wherein said enclosure is provided with a recess to accomodate a portion of said out-drive unit when said enclosure is mounted thereabout.

* * * * *